United States Patent [19]

Joulia

[11] Patent Number: 4,969,584

[45] Date of Patent: Nov. 13, 1990

[54] PRESSURIZED CONTAINER INCLUDING A SYSTEM FOR BLOCKING THE VALVE WHEN THE CONTAINER IS NOT IN A PROPER POSITION

[75] Inventor: Gérard Joulia, Paris, France

[73] Assignee: L'Oreal, Paris, France

[21] Appl. No.: 417,042

[22] Filed: Oct. 4, 1989

[30] Foreign Application Priority Data

Oct. 13, 1988 [FR] France ..... 88 13473

[51] Int. Cl.[5] ..... B65D 55/12; B65D 83/14

[52] U.S. Cl. ..... 222/402.11; 222/153; 251/65; 137/38

[58] Field of Search ..... 222/402.11, 402.13, 222/153, 504; 251/65; 137/38

[56] References Cited

U.S. PATENT DOCUMENTS

| | | | |
|---|---|---|---|
| 2,954,904 | 10/1960 | Potoczky | 222/402.11 |
| 3,186,605 | 6/1965 | Potoczky | 222/402.11 |
| 3,788,523 | 1/1974 | Thomas | 222/402.11 |
| 4,121,741 | 10/1978 | Adamson | 251/65 |
| 4,883,081 | 11/1989 | Morris | 251/65 |

*Primary Examiner*—Andres Kashnikow
*Assistant Examiner*—Karen B. Merritt
*Attorney, Agent, or Firm*—Cushman, Darby & Cushman

[57] ABSTRACT

A pressurized container (1) including a system for blocking the actuating device (5) of the valve (4) when the container (1) is not in a proper position is proposed, which includes a movable element (6), at least partly of ferromagnetic material, that cooperates with a magnet (33) having a force of magnetic attraction less than the weight of the movable element (6), and which is disposed in such a manner that the movable element is attracted and retained by the magnet to block the actuating device (5).

9 Claims, 2 Drawing Sheets

PRESSURIZED CONTAINER INCLUDING A SYSTEM FOR BLOCKING THE VALVE WHEN THE CONTAINER IS NOT IN A PROPER POSITION

FIELD OF THE INVENTION

The present invention relates to a pressurized container including a system for blocking the valve when the container is not in a proper position.

BACKGROUND OF THE INVENTION

Typically, pressurized containers of the aerosol bomb type comprise a can, most often cylindrical, that contains both the product to be dispensed and a pressurized propellant, as well as a valve to enable dispensing the product under the influence of the propellant and a device for actuation of the valve by the user.

The valve is usually disposed in the center of a cup that is generally crimped to the edge of the cylindrical can with a bead. It is actuated by a device that fits onto the pressurized container at the end having the valve. This device includes a skirt integrally joined to the cylindrical can in telescoping fashion or by being screwed to it; a regulating nozzle connected to the outlet tube of the valve, the outlet tube generally being fixed to the cup with the aid of a reinforcement; and a device for actuating the valve, hereinafter simply called a pushbutton, on which the user presses, and with which the valve can be made to operate and the product to be dispensed can be brought to the regulating nozzle.

Depending on how the product is to be dispensed, the pressurized container is made to function by keeping the valve at the top (a position hereinafter called top up) or at the bottom (a position hereinafter called top down). In the first case the valve is generally connected to a plunger tube located inside the container in such a way as to use the product contained until it is exhausted. If the container is used in an unsuitable position, the risk is that some of the propellant may escape by itself, without the product to be dispensed, or carrying only a small quantity of product to be dispensed with it.

Thus if the container is used in the wrong position, there may be a loss of the product, the propellant, or both.

The present applicant, in French Patent Application No. 88-06271 filed on May 10, 1988, has proposed a system that locks the pushbutton and prevents the opening of the valve when the pressurized container is not in the proper position. This system is located between the pushbutton and the cup in which the valve is disposed, and it includes a suitably inclined channel within which a movable device such as a ball circulates by gravity; when it is located at the end of the channel toward the valve, the device comes to block the pushbutton by cooperating with an integral portion of the pushbutton and an integral portion of the cup.

This blocking system, while providing notable progress, bears further improvement both in terms of simplicity of design and manufacture, and in terms of functional dependability. It is particularly important that the blocking and unblocking of the actuating device be reliable.

SUMMARY OF THE INVENTION

The primary object of the invention is to furnish a system for blocking of the valve of the pressurized container that meets the needs addressed above.

The invention relates to a pressurized container including a system for blocking the actuating device of the valve when the container is not in a proper position. On the end opposite the bottom, the container is provided with a cup in which the valve is disposed; the device for actuating the valve is provided with a pushbutton and forms a cap on top of the cup and valve. The blocking system is disposed between the cup and the actuating device of the valve and includes a movable device that, when the container is not in proper position, cooperates with a portion of the cup and an integral portion of the pushbutton to block the actuating device. According to the invention, this container is characterized in that the movable device is at least partially of ferromagnetic material, and that one of the integral portions at least partially comprises a magnet having a force of magnetic attraction less than the weight of the movable device and is disposed in such a manner that the movable device is attracted and held against the magnet to block the actuating device when the container is not in the proper position, while when the container is in proper position the action of gravity moves the movable device away from the magnet and frees the actuating device.

The movable device may be a roller but is preferably a ball.

The movable device may be of any ferromagnetic material, selected from the group comprising iron, nickel, cobalt, steel and their alloys. The magnet may comprise any magnetic material, such as nickel, cobalt, steel, aluminum-nickel-cobalt-iron alloys, or ferrites, such as barium or strontium. Preferably, it is manufactured from a material in the form of ferrite powder, bound by a polymer; such a material is easy to shape, particularly by molding.

The magnet preferably includes a concave surface making it possible to define with precision the location to which the movable device moves under magnetic attraction.

When the container must be used with the top down, the magnet comprises the integral portion of the cup and is disposed in the cup, between its edge and the fixation reinforcement of the outlet tube of the valve. The integral portion of the pushbutton is constituted by the wall of the pushbutton. This lateral wall preferably includes an excessive thickness facing the magnet.

When the container must be used with the top up, the integral portion of the pushbutton is constituted by the magnet, and the integral portion of the cup is a rigid element fixed in the cup facing the magnet. This rigid element may be fixed inside the cup parallel to the longitudinal axis of the container, either along the edge of the cup or, preferably, along the fixation reinforcement of the outlet tube of the valve. The rigid element has the shape for example of a polygonal or cylindrical ring that is introduced into the cup facing the magnet, in such a manner that it is retained in place by both the bead of the cup and the fixation reinforcement of outlet tube of the valve. The internal space defined by the polygonal ring, at least in its portion most remote from the bottom of the cup in a section perpendicular to the longitudinal axis of the container, has dimensions larger than those of the movable device.

The subject of the present invention will be better understood from the ensuing detailed description of two purely exemplary and non-limiting embodiments of a pressurized container according to the invention, taken in conjunction with the drawings.

DESCRIPTION OF THE PREFERRED EMBODIMENTS

Figure 3:
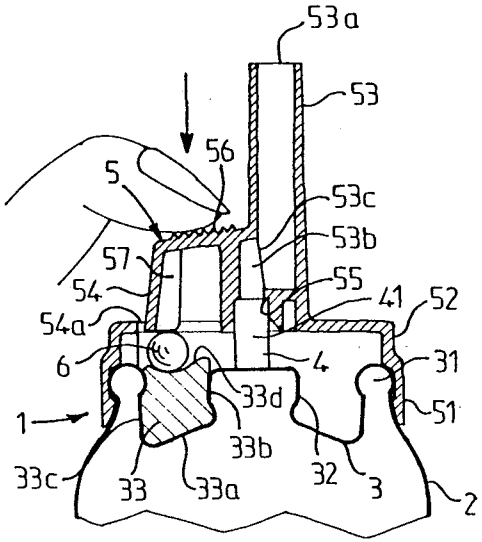
FIGS. 1–3 are diametrical sectional views of the end toward the valve of a pressurized container according to the invention, for use with the top down, with FIG. 1 showing the pressurized container in the top down position, FIG. 2 showing it in the intermediate position, and FIG. 3 showing it with its top upward.
Figure 2:
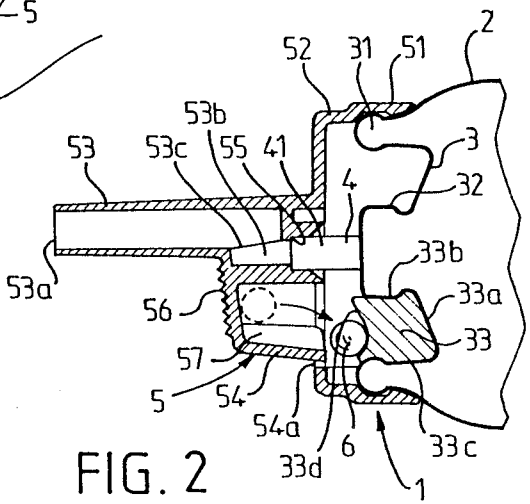
Figure 1:
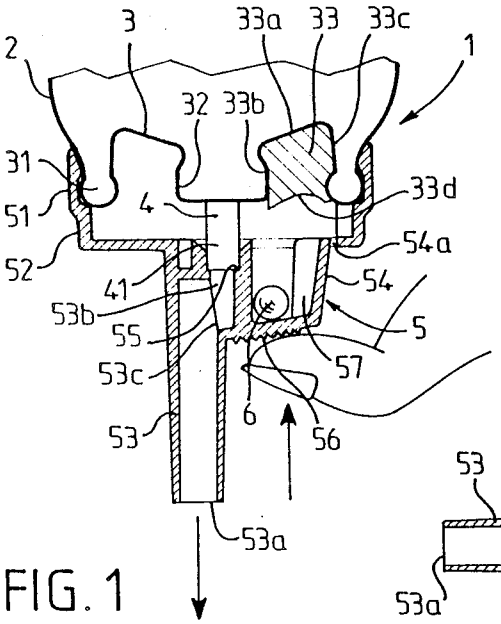

In FIGS. 1–3, the pressurized container, designated in its entirely by reference numeral 1, includes a cylindrical can 2, to one end of which a circular cup 3 is affixed that is provided with a valve 4, and to which a device 5 for actuating the valve 4 is fitted. The cup 3 is fixed to the edge of the cylindrical can 2 by a bead 31. The valve 4 is mounted in the center of the cup 3 in a fixation reinforcement 32 of roughly cylindrical shape. The valve 4 includes a dispensing tube 41. The device 5 for actuating the valve 4 includes a skirt 51 of cylindrical form that fits by elasticity over the bead 31 of the cup. The skirt includes one portion 52 of more constrained cross section, which is located beyond the bead 31 and makes possible the provision of a space between the cup 3 and the part of the valve actuating device 5 that forms the cap.

The device 5 includes a nozzle 53 comprising two conduits **53*a*, 53*b* parallel to the axis of the can 2 and offset with respect to one another and communicating with one another via an opening 53*c*. The conduit 53*b* is located in the extension of the outlet tube 41 of the valve 4. The device 5 for actuating the valve also includes a pushbutton 54, which has the shape of a sector of a circle centered on the conduit 53*a* of the nozzle 53. A slit 54*a* in the form of a circular arc is made in the base of a pushbutton, in such a way as to permit depressing the pushbutton when pressure is exerted on its surface 56. The pushbutton 54 contains the conduit 53*b*, which is closed by the surface 56 of the pushbutton. The conduit 53*b* includes a hole 55 into which the end of the outlet tube 41 of the valve 4 is inserted. In this way, if pressure is exerted on the surface 56 of the pushbutton and the pushbutton is depressed, the shoulder of the hole 55 is depressed and presses on the end of the outlet tube 41 of the valve 4, which causes the valve 4** to open.

As can be seen in FIGS. 1–3, the blocking system includes a ball 6, a magnet 33 which is disposed in the cup 3 facing the pushbutton 54, and a reinforcement 57 affixed on the inside of the pushbutton 54.

The magnet 33 has roughly the shape of a cube, one face **33*a* matching the shape of the bottom of the cup 3, and two faces 33*b* and 33*c* disposed respectively along the bead 31 and along the fixation reinforcement 32 of the valve 4. The free face 33*d*, opposite the face 33*a*, is concave, and its concavity is such that the ball 6 moves into the vicinity of the bead 31 facing the reinforcement 57** (see FIG. 3).

In the embodiment shown in FIGS. 1–3, the magnet is obtained by in situ molding of a polymer powder containing a ferrite in powdered form.

The integral element of the pushbutton is a reinforcement 57 affixed to the interior of the outer wall of the pushbutton 54 facing the magnet. It may be affixed for instance by gluing, but preferably it is provided at the same time as the device 5 for actuating the valve is molded. In the exemplary embodiment shown, this reinforcement 57 has a parallelepiped shape, which has the height of the lateral wall of the pushbutton as its longest dimension and presses with one of its faces against the internal wall of the surface 56; its opposite face is free, i.e., in the open.

The blocking system functions as follows: when the container is in the top down position (FIG. 1) the ball 6 is located inside the pushbutton 54. The space between the free face of the reinforcement 57 and the surface **33*d* of the magnet is empty. When the user presses on the surface 56 of the pushbutton 54** he depresses it, and the valve is actuated.

When the user inverts the pressurized container (FIG. 2), the ball 6 rolls on the reinforcement 57, is attracted by the magnet 33, and is fixed there under the influence of the force of Magnetic attraction. Under these conditions, when the container is in the undesirable top up position (see FIG. 3), the ball is retained between the magnet 33 and the reinforcement 57. Even if the user presses on the surface 56 of the pushbutton, the pushbutton cannot be depressed; consequently the valve 4 cannot be actuated, since the reinforcement 57 abuts against the ball 6, which prevents the depression of the pushbutton 54.

When the user inverts the container 1 to put it in the top down position, the ball moves away from the magnet 33 and drops inside the pushbutton 54, because the weight of the ball is greater than the force of magnetic attraction of the magnet.

Figure 6:
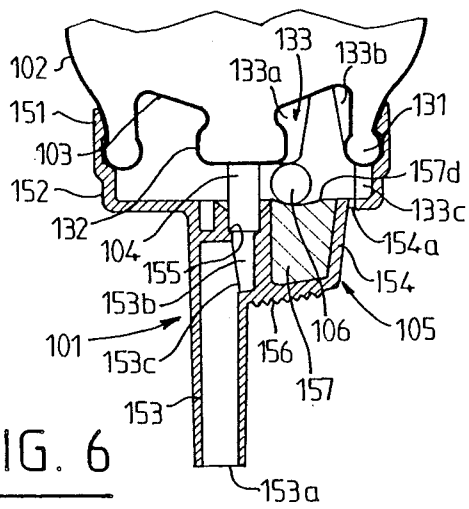
FIGS. 4–6 are diametrical sections of the end toward the valve of a pressurized container according to the invention for use in the top up position, with FIG. 4 showing the container in the top up position, FIG. 5 showing it in the intermediate position, and FIG. 6 showing it in a top down position.
Figure 5:
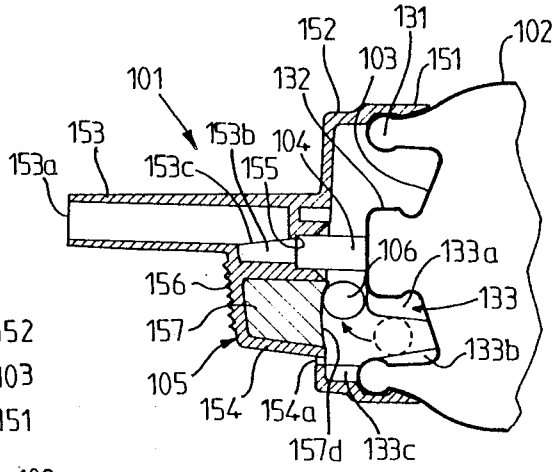
Figure 4:
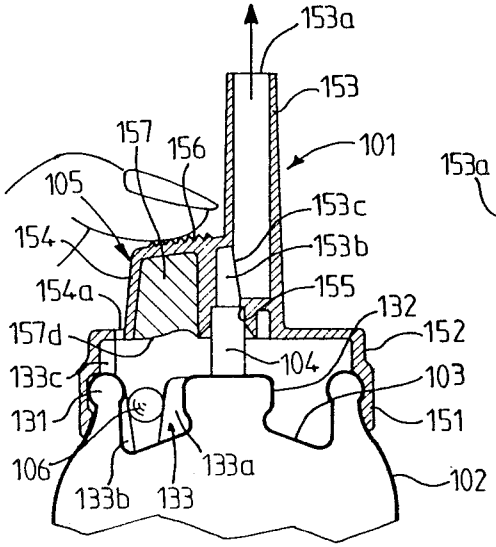

Turning now to FIGS. 4–6, a pressurized container that must be used in the top up position is shown.

In these figures, the constituent elements identical to those already described in conjunction with FIGS. 1–3 are identified by the same reference numerals, raised by 100, except for elements 133 and 159. Elements found in FIGS. 1–3 will not be described again here.

The blocking system includes a ball 106, a magnet 157 that is integral with the pushbutton 154, and an element 133 integral with the cup 103. As described in the case of FIGS. 1–3, the magnet 157 is molded from a powder of polymerizable substance and ferrite. The magnet 157 occupies the entire internal cavity of the pushbutton 154, and its free surface **157*d* is concave, so that the ball comes to be fixed in the vicinity of the common partition of the pushbutton 154 and the conduit 153*b* of the nozzle 153**.

The element 133 integral with the cup 103 comprises an annular four-sided polygonal part, made from plastic material. One of the faces **133*a* presses on the fixation reinforcement 132 of the valve 104; the contact face is complementary in shape to the reinforcement 132. Another face 133*b* presses on the fixation bead 131 of the cup 103, and that contact face is again complementary in shape to the bead 131**.

The internal space of the element 133, in its portion closest to the pushbutton, in perpendicular section to the longitudinal axis of the container, has dimensions larger than the diameter of the ball.

The blocking system functions as follows: when the pressurized container is in the top up position (FIG. 4), the ball is lodged in the internal space of the element 133. The space between the free face 157*d* of the magnet and the free face of the side 133*a* of the element 133 is empty. When the use presses on the surface 156 of the pushbutton 154, he depresses it, and the valve 104 is actuated.

When the user inverts the container 101 (FIG. 5) the ball rolls on the side 133*b* of the element 133, is attracted by the magnet 157, and is fixed on it by the force of magnetic attraction.

Under these conditions, when the container 101 is in the top down position (FIG. 6), the ball fills the space between the magnet 157 and the side 133*a* of the element 133. When the user presses on the surface 156 of the pushbutton 154, the pushbutton cannot be depressed, because it is abutting against the ball 106. Consequently the valve 104 cannot be actuated.

When the container 101 is returned to the top up position, the ball drops back into the internal space of the element 13 by gravity, because the force of attraction of the magnet 157 is less that the weight of the ball. The valve 104 can be actuated again.

What is claimed is:

1. A pressurized container (1, 101) including a system for blocking an actuating device (5, 105) of a valve (4, 104) when the container (1, 101) is not in a proper position, the container (1, 101) being provided at the end opposite the bottom with a cup (3, 103) in which the valve (4, 104) is disposed, the device (5, 105) for actuating the valve (4, 104) being provided with a pushbutton (54, 154) and forming a cap on top of the cup (3, 103) and valve (4, 104), the blocking system being disposed between the cup (3, 103) and the actuating device (5, 105) of the valve (4, 104) and including a movable device (6, 106) that, when the container (1, 101) is not in proper position, cooperates with an integral portion of the cup (3, 103) and an integral portion of the pushbutton (54, 154) to block said actuating device (5, 105), characterized in that the movable device (6, 106) is at least partially of ferromagnetic material, and that one of the integral portions at least partially comprises a magnet (33, 157) having a force of magnetic attraction less than the weight of the movable device and being disposed in such a manner that the movable device is attracted and held against said magnet to block the actuating device when the container is not in proper position, while when the container is in the proper position the action of gravity moves the movable device away from the magnet and frees the actuating device.

2. A container as defined by claim 1, characterized in that the movable device (6, 106) is a ball.

3. A container as defined by claim 1, characterized in that the movable device (6, 106) is of a ferromagnetic material selected from the group comprising iron, nickel, cobalt, steel, and their alloys.

4. A container as defined by claim 1, characterized in that the magnet (33, 157) comprises a polymer containing ferrite powder.

5. A container as defined by claim 1, characterized in that the magnet (33, 157) includes a concave surface making it possible to define with precision the location where the movable device (6, 106) comes to be placed by magnetic attraction.

6. A container as defined by claim 1 that must be used in the top down position, characterized in that the magnet (33) is disposed in the cup (3) between a fixation bead (31) of the cup and a fixation reinforcement (32) of the valve (4), and that the integral portion of the pushbutton (54) is embodied by a wall of the pushbutton.

7. A container as defined by claim 6, characterized in that the wall of the pushbutton includes a portion (57) of excessive thickness facing the magnet.

8. A container as defined by claim 1 that must be used in the top down position, characterized in that the magnet (157) is integral with the pushbutton (154), and that the integral portion of the cup (103) is a rigid element (133) fixed in the cup (103).

9. A container as defined by claim 8, characterized in that the rigid element (133) has the form of a polygonal or cylindrical ring placed in the cup (103) facing the magnet (157) in such a way as to be retained by an edge of the cup and a fixation reinforcement of a fixation conduit of the valve (132), the internal space defined by the ring having dimensions, at least in its portion most remote from the bottom of the cup (103), that are larger than those of the movable device (106).

* * * * *